US009220993B1

(12) United States Patent
Alsaleh et al.

(10) Patent No.: US 9,220,993 B1
(45) Date of Patent: Dec. 29, 2015

(54) SET OF CONSTRUCTION PANELS

(71) Applicants: Ahmad A. A. A. Alsaleh, Ishbilya (KW); Naser H. N. Jasem, Al Shuhada (KW)

(72) Inventors: Ahmad A. A. A. Alsaleh, Ishbilya (KW); Naser H. N. Jasem, Al Shuhada (KW)

( * ) Notice: Subject to any disclaimer, the term of this patent is extended or adjusted under 35 U.S.C. 154(b) by 0 days.

(21) Appl. No.: 14/842,744

(22) Filed: Sep. 1, 2015

(51) Int. Cl.
*A63H 33/04* (2006.01)
*A63H 33/08* (2006.01)
*E04B 1/00* (2006.01)

(52) U.S. Cl.
CPC ..... *A63H 33/08* (2013.01)

(58) Field of Classification Search
CPC ..... A63H 33/00; A63H 33/04; A63H 33/08; A63H 33/12; A63H 33/16; A63H 33/107; A63H 33/108; E04B 1/00; E04B 1/3421; E04B 1/34384; Y10T 24/53; Y10T 24/49826
USPC ..... 446/85, 108, 111, 113–116, 120, 124, 446/126; 269/289 R, 900, 302.1, 43, 47
See application file for complete search history.

(56) References Cited

U.S. PATENT DOCUMENTS 1,890,269 A * 12/1932 Swanson ..... A63H 33/06 446/102
4,602,908 A * 7/1986 Kroeber ..... A63H 33/088 446/124
4,792,319 A 12/1988 Svagerko
5,853,313 A 12/1998 Zheng
6,089,941 A 7/2000 Glickman et al.
6,648,715 B2 11/2003 Wiens et al.
7,749,042 B2 7/2010 Fulgenzi
8,033,537 B2 * 10/2011 Wuethrich ..... F16B 5/02 269/289 R
D676,496 S 2/2013 Mimlitch, III et al.
2012/0071061 A1 3/2012 Smith et al.

FOREIGN PATENT DOCUMENTS

GB 2 118 447 A 11/1983

* cited by examiner

*Primary Examiner* — Kien Nguyen
(74) *Attorney, Agent, or Firm* — Richard C. Litman

(57) ABSTRACT

The set of construction panels is a set of toy building panels including two basic types of construction panels. The first type of construction panel includes a first planar member having at least one side edge and at least one first engaging member protruding from the at least one side edge thereof. A plurality of first apertures are formed through the first planar member, such that the plurality of first apertures are arrayed as a regular rectangular grid. The second type of construction panel includes an elongated planar member having at least one side edge and at least one second engaging member protruding from the at least one side edge thereof. A linear row of second apertures are formed through the elongated planar member. The construction panels may be releasably connected together by releasable insertion of the engaging members of one panel into the apertures of another panel.

14 Claims, 7 Drawing Sheets

SET OF CONSTRUCTION PANELS

BACKGROUND OF THE INVENTION

1. Field of the Invention

The present invention relates generally to toys, and particularly to a set of building or construction panels where each panel includes edge-protruding engagement members for releasable engagement with corresponding apertures formed through a planar portion of each panel.

2. Description of the Related Art

Building structures for children are typically either cube-shaped blocks that simply sit next to and on top of one another, or lock together using a series of protrusions and corresponding recesses. In the latter case, the protrusions are commonly formed on the top of each panel for reception in recesses formed in the bottom of an adjacent panel. Although structures formed from such blocks provide vertical stability in a similar manner to that of a brick wall, there is no direct horizontal linkage between horizontally adjacent ones of the blocks, thus making a structure formed from such blocks fundamentally weak. Further, as the sides of the blocks are not in direct connection with one another, secure connections for structures other than planar walls, such as a perpendicular joint between two blocks, are not possible. Thus, a set of construction panels addressing the aforementioned problems is desired.

SUMMARY OF THE INVENTION

The set of construction panels is a set of toy building panels. Each panel is generally flat or planar having a flange extending from at least one edge of the panel, one or more pegs or engaging members extending from the flange, and one or more sockets or apertures defined in the panel. Accordingly, a first type of construction panel can include a first planar member having at least one side edge and at least one first engaging member protruding from the at least one side edge thereof. A plurality of first apertures are formed through the first planar member. The plurality of first apertures can for example, be arrayed as a regular rectangular grid. A second type of construction panel can include an elongated planar member, i.e., narrower than the first construction panel, having at least one side edge and at least one second engaging member protruding from the at least one side edge. A linear row of second apertures can be formed through the elongated planar member. In use, one construction panel may be releasably connected to another by releasable insertion of at least one of the engaging members of one panel into at least one of the apertures of the other panel.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
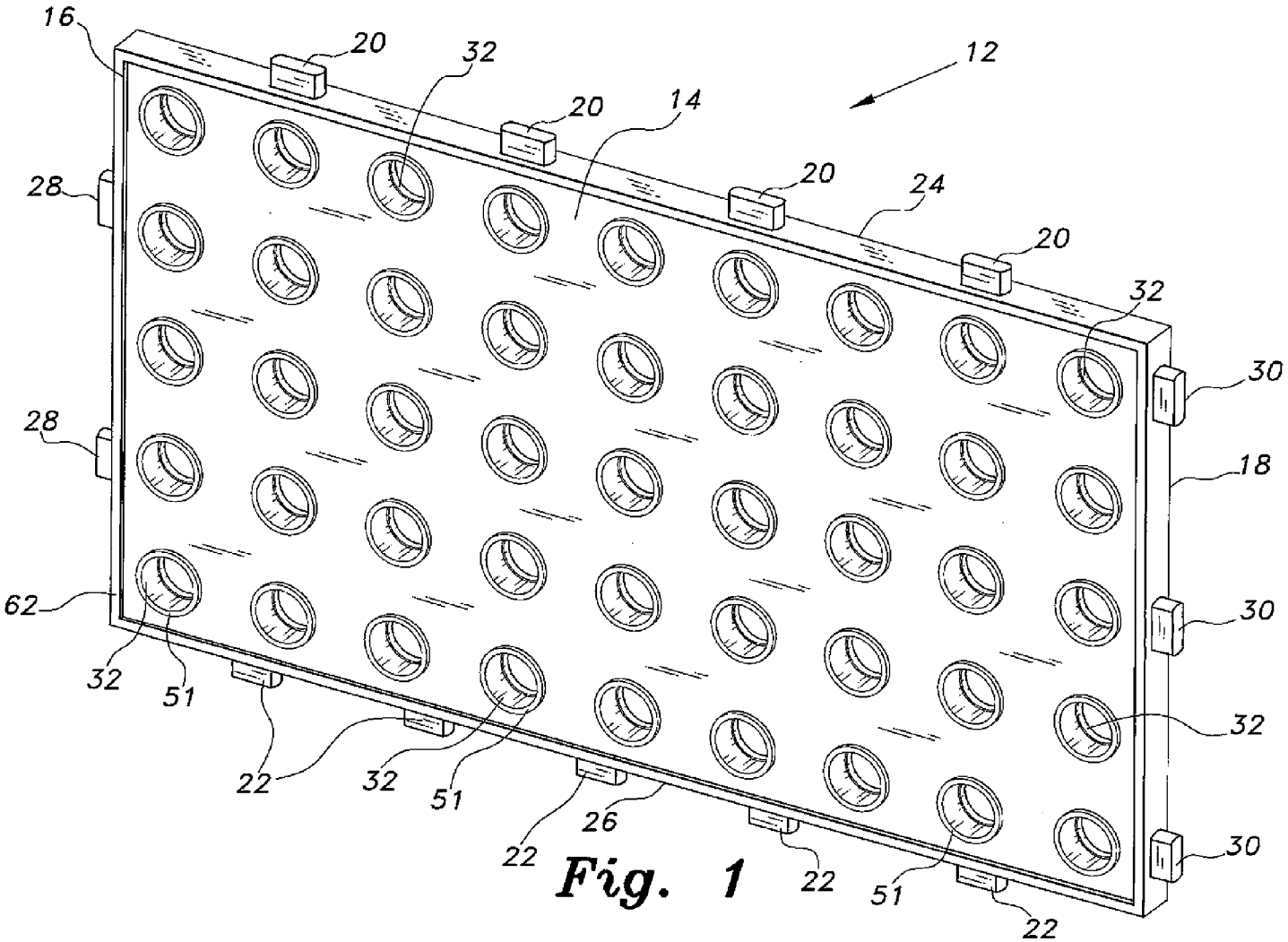
FIG. 1 is a perspective view of a first type of construction panel of a set of construction panels according to the present invention.

The set of construction panels 10 is a set of toy building panels. Each panel can have a generally flat or planar member, a flange extending from the peripheral edge of the planar member, pegs or engaging members extending from the flange, and sockets or apertures defined in the planar member. The dimensions and shapes of the planar members can vary. For example, referring to FIG. 1, a first type of construction panel 12 can include a first planar member 14. In FIG. 1, the first type of construction panel 12 is shown as having a rectangular contour, although it should be understood that this rectangular contour is shown for exemplary purposes only, and that the first type of construction panel 12 may have any desired overall contouring and relative dimensions.

In the rectangular example of FIG. 1, the first construction panel 12 has a pair of longitudinally opposed side edges 16, 18 and a pair of laterally opposed side edges 24, 26. The pair of longitudinally opposed side edges 16, 18 and the pair of laterally opposed side edges 24, 26 can form a flange 62 extending from the periphery of the first planar member 14.

As shown, a plurality of first apertures 32 are formed through the first planar member 14, such that the plurality of first apertures 32 are arrayed as a regular rectangular grid; i.e., the first apertures 32 define a plurality of linear, longitudinally extending rows of first apertures (extending from side edge 16 to side edge 18) and also a plurality of linear, laterally extending rows of first apertures (extending from side edge 24 to side edge 26). In FIG. 1, the first type of construction panel 12 is shown as having five linear, longitudinally extending rows of first apertures and nine linear, laterally extending rows of first apertures, however, as noted above, this configuration is shown for exemplary purposes only, and any desired number of apertures 32 may be formed through the first planar member 14 in any desired grid arrangement.

Preferably, as shown in FIG. 1, the first engaging members include a plurality of first engaging members 28, 30 protruding from each of the longitudinally opposed side edges 16, 18, respectively, and also a plurality of first engaging members 20, 22 protruding from each of the laterally opposed side edges 24, 26, respectively. In the example of FIG. 1, in which there are five linear, longitudinally extending rows of first apertures 32, there are two engaging members 28 protruding from side edge 16 and three engaging members 30 protruding from side edge 18. In general, the engaging members 28, 30 protruding from each of the longitudinally opposed side edges 16, 18, respectively, can correspond in position to, i.e., can be aligned with, alternating ones of the plurality of linear, longitudinally extending rows of first apertures. Similarly, in the example of FIG. 1, where there are nine linear, laterally extending rows of first apertures 32, there are four engaging members 20 protruding from side edge 24 and five engaging members 22 protruding from side edge 26. In general, the engaging members 20, 22 protruding from each of the laterally opposed side edges 24, 26, respectively, correspond in position to, i.e., can be aligned with, alternating ones of the plurality of linear, laterally extending rows of first apertures.

Figure 2:
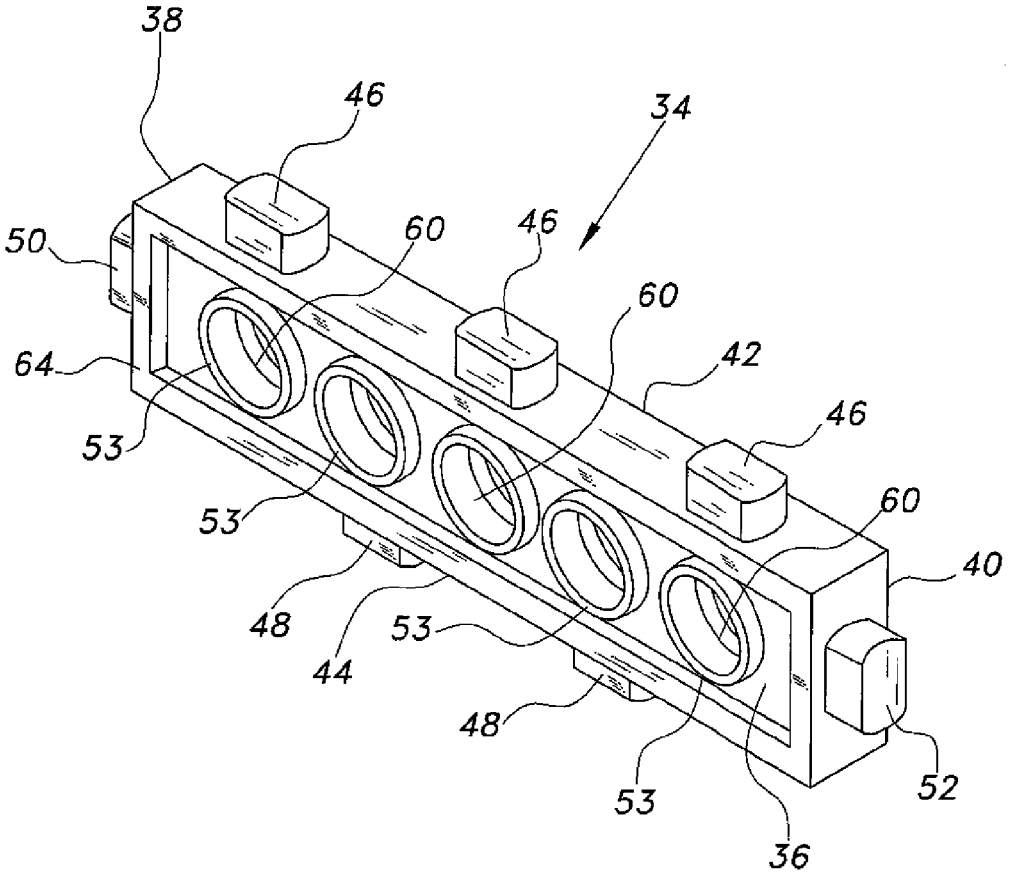
FIG. 2 is a perspective view of a second type of construction panel of the set of construction panels according to the present invention.

FIG. 2 shows a second type of construction panel 34, which includes an elongated planar member 36 having at least one side edge and at least one second engaging member protruding from the at least one side edge thereof. In FIG. 2, the second type of construction panel 34 is shown as having a rectangular contour, although it should be understood that this rectangular contour is shown for exemplary purposes only, and that the second type of construction panel 34 may have any desired overall contouring and relative dimensions. In the rectangular example of FIG. 2, the second type of construction panel 34 has a pair of longitudinally opposed side edges 38, 40 and a pair of laterally opposed side edges 42, 44. The pair of longitudinally opposed side edges 38, 40 and the pair of laterally opposed side edges 42, 44 can form a flange 64 extending from the periphery of the planar member 36.

As further shown in FIG. 2, a single linear row of second apertures 60 are formed through the elongated planar member 36. Similar to the first type of construction panel 12, the second type of construction panel 34, in the rectangular example of FIG. 2, includes a plurality of second engaging members 46, 48 protruding from each of the laterally opposed side edges 42, 44, respectively, of the elongated planar member 36. In the example of FIG. 2, in which there are five apertures 60 formed through the elongated planar member 36 in a linear row, there are three second engaging members 46 and two second engaging members 48, corresponding to laterally opposed side edges 42, 44, respectively. In general, the plurality of second engaging members 46, 48 protruding from each of the laterally opposed side edges 42, 44, respectively, correspond in position to, i.e., are aligned with, alternating ones of the second apertures 60. Additionally, as shown, a single engaging member 50, 52 protrudes from each of the longitudinally opposed side edges 38, 40, respectively.

In the example of FIGS. 1 and 2, each of the first and second apertures 32, 60 is shown as being circular, although it should be understood that apertures 32, 60 may have any desired contouring or size. The first engaging members 20, 22, 28, 30 and the second engaging members 46, 48, 50, 52 are each shown as having a substantially oval cross-sectional contour, with a major axis approximately equal to the diameter of each of first and second apertures 32, 60. It should be understood that the first engaging members 20, 22, 28, 30 and the second engaging members 46, 48, 50, 52 may have any desired contouring and relative dimensions such that each of the first engaging members 20, 22, 28, 30 and the second engaging members 46, 48, 50, 52 fits snugly within one of first and second apertures 32, 60 such that individual panels of the set 10 may be releasably secured to one another through releasable frictional engagement of at least one engaging member in at least one aperture.

It should be understood that each of the panels of set 10 may be manufactured from any suitable material, such as plastic, wood, metal or the like. In FIG. 1, each of the first apertures 32 is shown surrounded by a raised rim or lip 51. Similarly, in FIG. 2, each of the second apertures 60 is shown surrounded by a raised rim or lip 53.

Figure 3A:
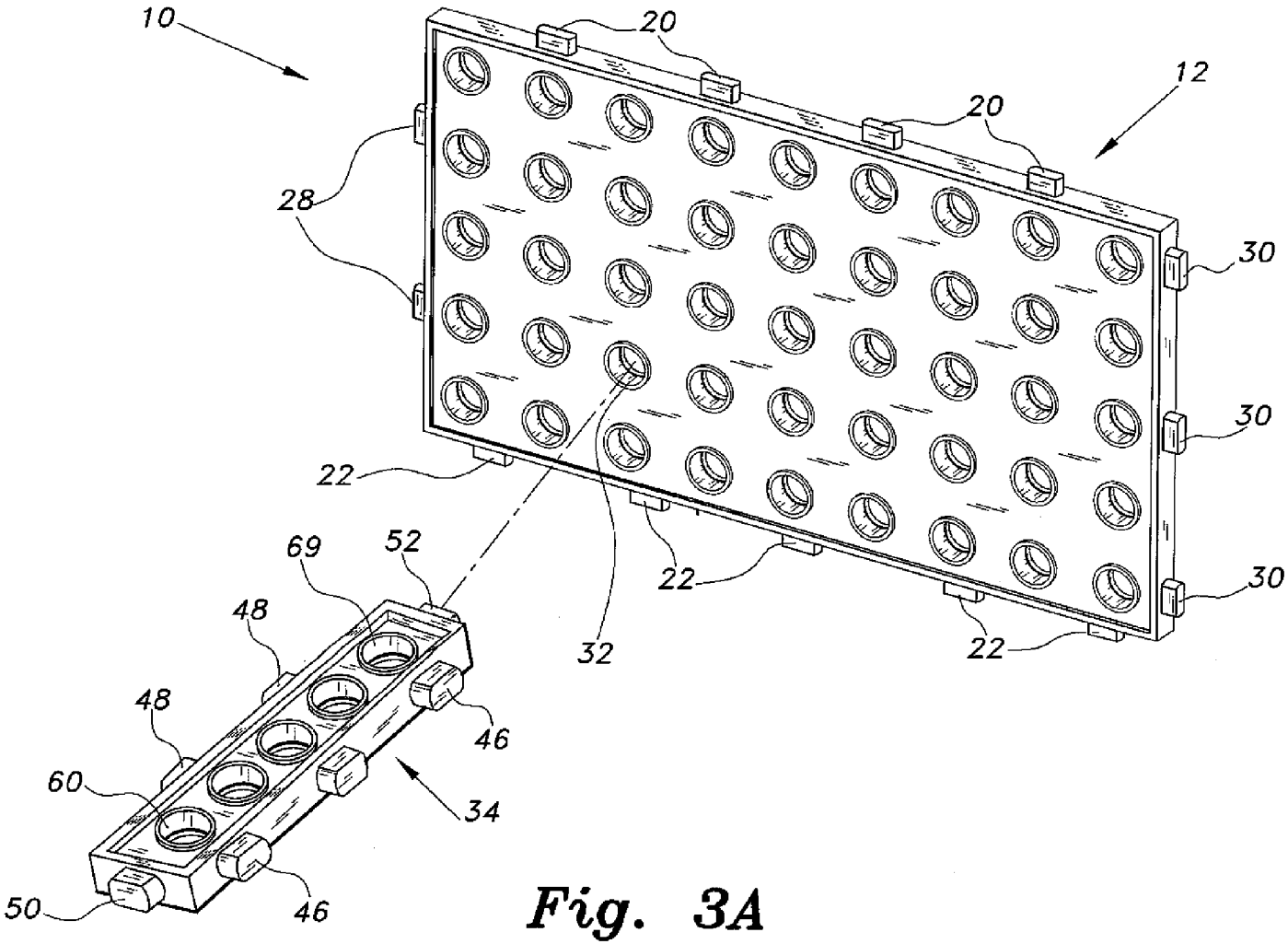
FIG. 3A is a perspective view of one of the first type of construction panels being releasably connected to one of the second types of construction panels.

It should be further understood that set 10 preferably includes multiple ones of each of the first type of construction panel 12 and the second type of construction panel 34. In FIG. 3A, for illustrative purposes, a simple set 10 is shown composed of one of the first type of construction panels 12 and one of the second type of construction panels 34. In the example of FIG. 3A, a single engaging member 52 of the second type of construction panel 34 is shown being inserted into a selected one of first apertures 32 of the first type of construction panel 14 to releasably secure the second type of construction panel 34 to the first type of construction panel 14. It should be understood that this configuration is shown for illustrative and exemplary purposes only, and that any of engaging members of one of the panels may be inserted into any of the apertures of the other one of the panels to releasably secure the two panels together in any desired configuration.

Figure 3B:
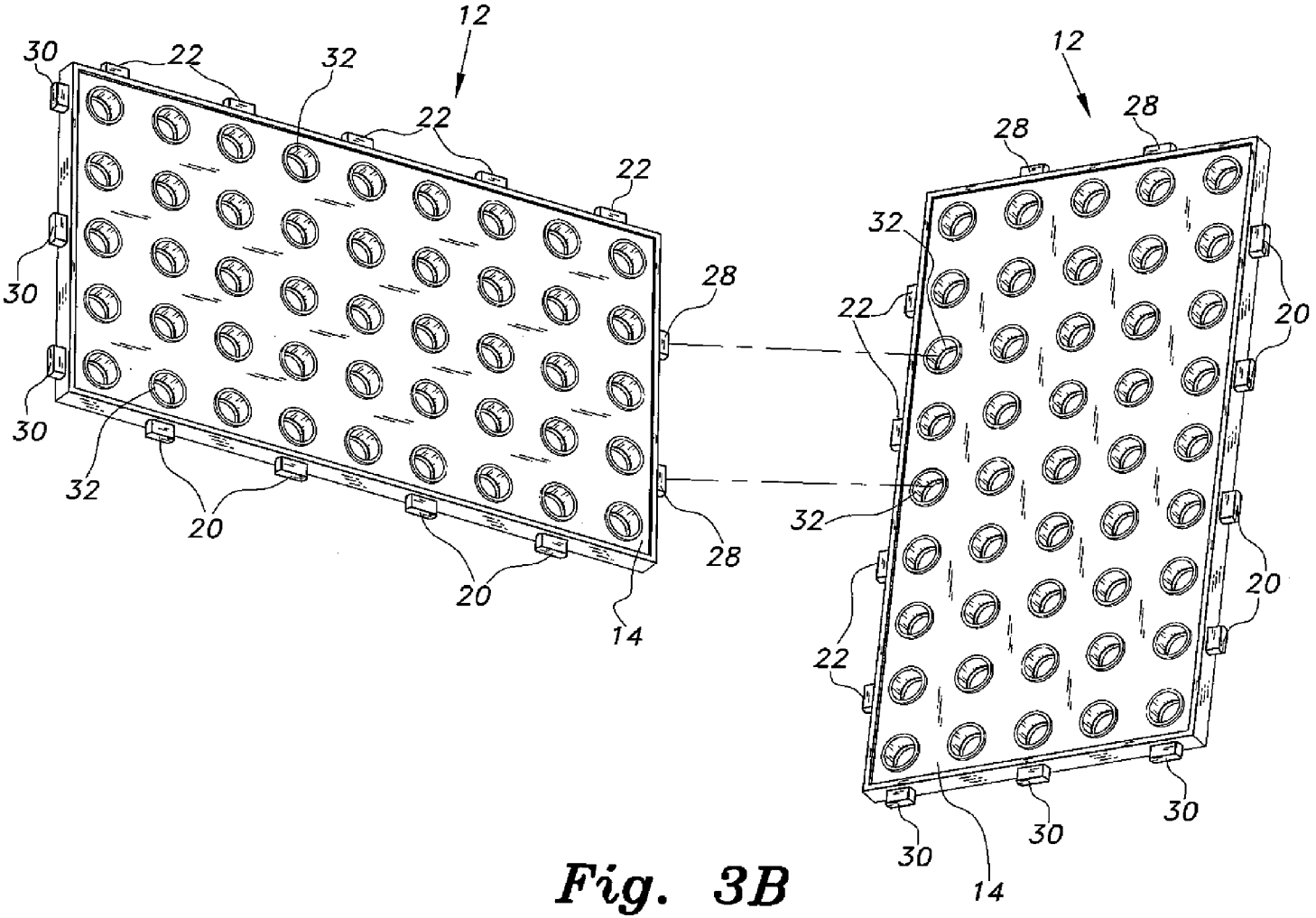
FIG. 3B is a perspective view of one of the first type of construction panels being releasably connected to another one of the first types of construction panels.
Figure 3C:
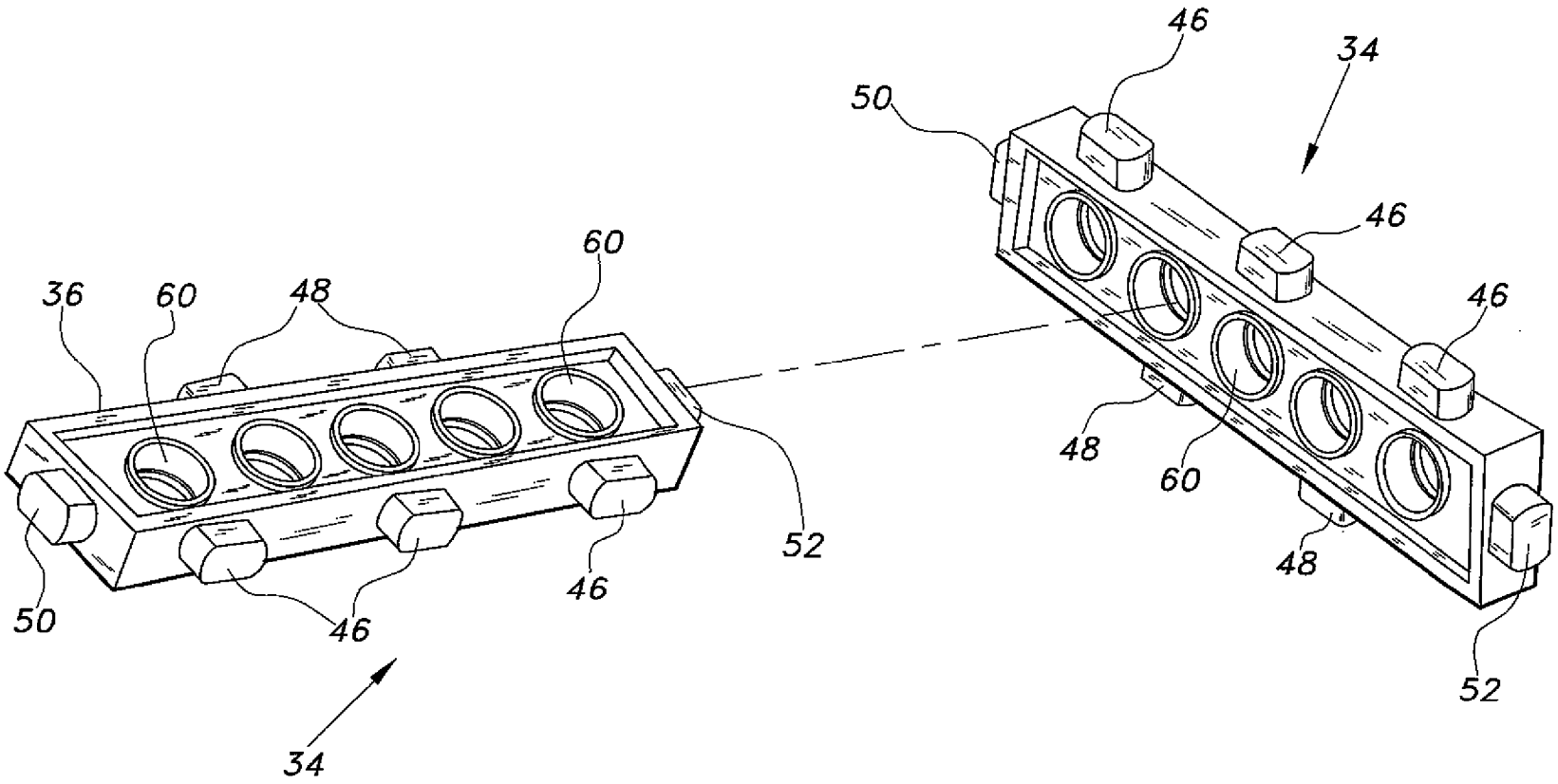
FIG. 3C is a perspective view of one of the second type of construction panels being releasably connected to another one of the second types of construction panels.

As shown in FIGS. 3B and 3C, panels of the same type may also be releasably secured to one another. In the example of FIG. 3B, a pair of engaging members 28 of the first type of construction panel 12 is shown being inserted into a selected pair of first apertures 32 of another one of the first type of construction panel 14. In FIG. 3C, a single engaging member 52 of the second type of construction panel 34 is shown being inserted into a selected one of second apertures 60 of another one of the second type of construction panel 34. It should be understood that the configurations of FIGS. 3B and 3C are also shown for illustrative and exemplary purposes only, and that any of engaging members of one of the panels may be inserted into any of the apertures of the other one of the panels to releasably secure the two panels together in any desired configuration.

Figure 4:
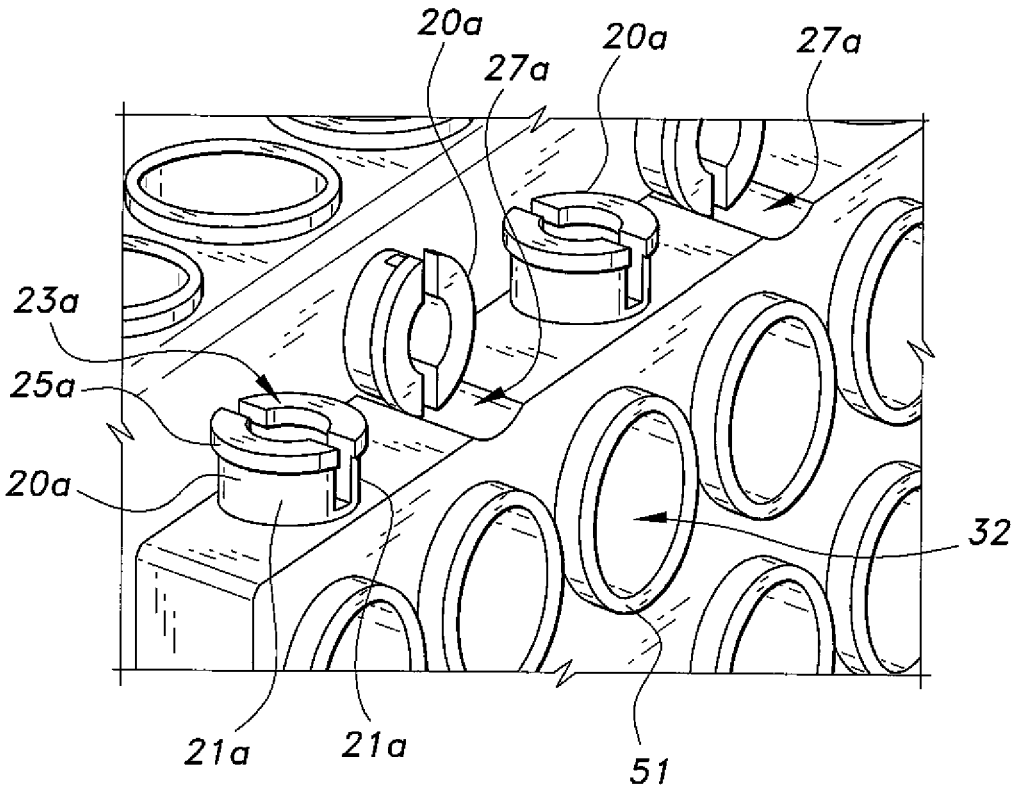
FIG. 4 is a partial perspective view of an alternative embodiment of the set of construction panels.

In the alternative embodiment of FIG. 4, engaging members 20*a* (which serve a similar function as engaging members 20, 46) are formed as substantially cylindrical shells, with an axial cut 23*a* being formed therethrough, thus dividing each engaging member 20*a* into a pair of semi-cylindrical shell members 21*a*, as shown. A raised lip 25*a* is preferably formed circumferentially about the free end of engaging member 20*a*, as shown. Each engaging member 20*a* preferably has a diameter approximately equal to the diameter of the apertures 32, 60, with the raised lip 25*a* having a greater diameter. Thus, in order to insert one of the engaging members 20*a* into a corresponding aperture 32, 60, similar to the embodiments of FIGS. 3A, 3B and 3C, the pair of semi-cylindrical shell members 21*a* can be squeezed together such that the raised lip 25*a* will fit through the selected aperture 32, 60. Once the engaging member 20*a* has been fully inserted, the resilient material used to form the engaging member 20*a* restores it to its original configuration, thus releasably locking the engaging member 20*a* in the aperture 32, 60, with the raised lip 25*a* resting on the raised rim or lip 51, 53 of the corresponding aperture 32, 60.

Further, semi-cylindrical grooves 27*a* may be formed between adjacent pairs of engaging members 20*a*, as further shown in FIG. 4. As shown, this allows engaging members 20*a* from another construction panel to releasably, frictionally engage the semi-cylindrical grooves 27*a*, providing a further method of securing the construction panels to one another.

As noted above, construction panels 12 and 34 are shown for exemplary purposes only, and the basic construction panels may have any desired relative dimensions and overall contouring. It should be understood that similar panels with different contouring (such as with angles, curves and the like) are also contemplated within the scope of the present invention. Further, it should be understood that the basic construction panels 12 and 34 may be used in combination with additional structural elements, as is well known in the field of construction blocks, bricks and panels. For example, panels 12, 34 may be provided in a kit or set which includes additional components, such as, brackets, caps, covers, shells, wheels, gears, connectors, axles, hinges, cogs, rods, bands, shafts, motor mounts, bushes, frames, couplings, battery casings, adapters and the like, as is well known in the field of construction blocks, bricks and panels. In particular, such a kit or set can include, in addition to panels 12, 34, components suitable for a robot construction kit. Further, as described above, it should be understood that variations in the relative dimensions of the basic construction panels 12, 34 is contemplated by the present invention, as well as variations in the overall contouring of the basic construction panels 12, 34, such as, for example, the addition of bends or angles in the construction panels.

Figure 5:
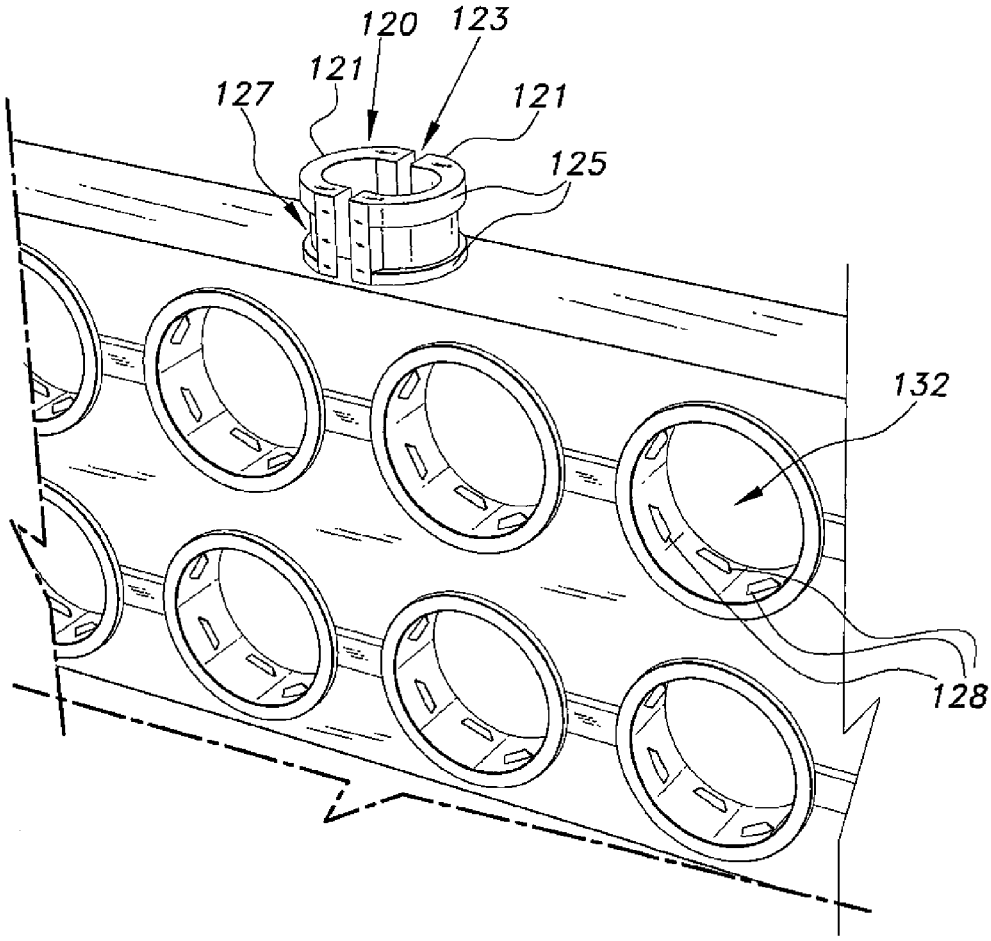
FIG. 5 is a partial perspective view of another alternative embodiment of the set of construction panels.

In the alternative embodiment of FIG. 5, engaging members 120 (which serve a similar function as engaging members 20, 46, 20*a*) are formed as substantially cylindrical shells, with an axial cut 123 being formed therethrough (similar to cut 23*a* of the embodiment of FIG. 4), thus dividing each engaging member 120 into a pair of semi-cylindrical shell members 121, similar to the previous embodiment. A pair of raised lips 125 are preferably formed circumferentially about the opposed ends of engaging member 120, as shown, thus defining an annular recess 127 therebetween.

Each engaging member 120 preferably has a diameter approximately equal to the diameter of the apertures 132 (similar to apertures 32, 60), with the raised lips 125 having a greater diameter. Thus, in order to insert one of the engaging members 120 into a corresponding aperture 132, the pair of semi-cylindrical shell members 121 can be squeezed together such that the free one of the raised lips 125 will fit through the selected aperture 132, similar to the previous embodiment. Once the engaging member 120 has been fully inserted, the resilient material used to form the engaging member 120 restores it to its original configuration, thus releasably locking the engaging member 120 in the aperture 132, as in the embodiment of FIG. 4. However, as shown in FIG. 5, teeth 128 may be formed on the inner surface of aperture 132. These teeth 128, which may be arrayed circumferentially, as shown in FIG. 5, releasably engage annular recess 127 of engaging member 120.

It is to be understood that the present invention is not limited to the embodiments described above, but encompasses any and all embodiments within the scope of the following claims.

We claim:

1. A set of construction panels, comprising:

at least one first construction panel comprising a first planar member having at least one side edge and at least one first engaging member protruding from the at least one side edge thereof, a plurality of first apertures are formed through the first planar member, the plurality of first apertures being arrayed as a regular rectangular grid, the plurality of first apertures defines a plurality of linear, longitudinally extending rows of first apertures, wherein the at least one first engaging member comprises a plurality of first engaging members protruding from each of the longitudinally opposed side edges of the first planar member, the plurality of first engaging members protruding from each of the longitudinally opposed side edges in alignment with alternating ones of the plurality of linear, longitudinally extending rows of first apertures;

at least one second construction panel comprising a second planar member having at least one side edge and at least one second engaging member protruding from the at least one side edge thereof, a plurality of second apertures are formed through the second planar member, the plurality of second apertures being arrayed as a regular rectangular grid, the plurality of second apertures defines a plurality of linear, longitudinally extending rows of second apertures, wherein the at least one second engaging member comprising a plurality of second engaging members protruding from each of the longitudinally opposed side edges of the second planar member, the plurality of second engaging members protruding from each of the longitudinally opposed side edges in alignment with alternating ones of the plurality of linear, longitudinally extending rows of second apertures; and at least one third construction panel comprising an elongated planar member having at least one side edge and at least one third engaging member protruding from the at least one side edge thereof, wherein a linear row of third apertures are formed through the elongated planar member, whereby the at least one first construction panel may be releasably connected to the at least one second construction panel by releasable insertion of at least one of the at least one first engaging member or the at least one second engaging member in a corresponding at least one of the second apertures or the first apertures, respectively.

2. The set of construction panels as recited in claim 1, wherein each of the at least one first construction panel and the at least one second construction panel has a substantially rectangular contour having a pair of longitudinally opposed side edges and a pair of laterally opposed side edges.

3. The set of construction panels as recited in claim 1, wherein the plurality of first apertures further defines a plurality of linear, laterally extending rows of first apertures, and the plurality of second apertures further defines a plurality of linear, laterally extending rows of second apertures.

4. The set of construction panels as recited in claim 3, wherein the at least one first engaging member further comprises a plurality of first engaging members protruding from each of the laterally opposed side edges of the first planar member, the plurality of first engaging members protruding from each of the laterally opposed side edges in alignment with alternating ones of the plurality of linear, laterally extending rows of first apertures, and the at least one second engaging member comprising a plurality of second engaging members protruding from each of the laterally opposed side edges of the second planar member, the plurality of second engaging members protruding from each of the laterally opposed side edges in alignment with alternating ones of the plurality of linear, laterally extending rows of second apertures.

5. The set of construction panels as recited in claim 4, wherein the elongated planar member of the at least one third construction panel has a pair of longitudinally opposed side edges and a pair of laterally opposed side edges, the at least one third engaging member comprising a plurality of third engaging members protruding from each of the laterally opposed side edges of the elongated planar member, the plurality of third engaging members protruding from each of the laterally opposed side edges in alignment with alternating ones of the third apertures.

6. The set of construction panels as recited in claim 1, wherein each of the first and second apertures is substantially circular, and each of the at least one first engaging member and the at least one second engaging member has a substantially oval cross-sectional contour.

7. The set of construction panels as recited in claim 1, wherein each of the first and second apertures is substantially circular, and each of the at least one first engaging member and the at least one second engaging member comprises a substantially cylindrical shell having an axial cut formed therethrough to define a pair of semi-cylindrical shell members, a free end of each of the semi-cylindrical shell members having a raised lip formed thereon.

8. A set of construction panels, comprising:

at least one first construction panel comprising a first planar member having at least one side edge and at least one first engaging member protruding from the at least one side edge thereof, a plurality of first apertures are formed through the first planar member, the plurality of first apertures being arrayed as a regular rectangular grid, the at least one first construction panel has a substantially rectangular contour having a pair of longitudinally opposed side edges and a pair of laterally opposed side edges, the plurality of first apertures defining a plurality of linear, longitudinally extending rows of first apertures, wherein the at least one first engaging member comprises a plurality of first engaging members protruding from each of the longitudinally opposed side edges of the first planar member, the plurality of first engaging members protruding from each of the longitudinally opposed side edges in alignment with alternating ones of the plurality of linear, longitudinally extending rows of first apertures; and at least one second construction panel comprising an elongated planar member having at least one side edge and at least one second engaging member protruding from the at least one side edge thereof, wherein a linear row of second apertures are formed through the elongated planar member, whereby the at least one first construction panel may be releasably connected to the at least one second construction panel by releasable insertion of at least one of the at least one first engaging member or the at least one second engaging member in a corresponding at least one of the second apertures or the first apertures, respectively.

9. The set of construction panels as recited in claim 8, wherein the plurality of first apertures further defines a plurality of linear, laterally extending rows of first apertures.

10. The set of construction panels as recited in claim 9, wherein the at least one first engaging member further comprises a plurality of first engaging members protruding from each of the laterally opposed side edges of the first planar member, the plurality of first engaging members protruding from each of the laterally opposed side edges in alignment with alternating ones of the plurality of linear, laterally extending rows of first apertures.

11. The set of construction panels as recited in claim 10, wherein the elongated planar member of the at least one second construction panel has a pair of longitudinally opposed side edges and a pair of laterally opposed side edges, the at least one second engaging member comprising a plurality of second engaging members protruding from each of the laterally opposed side edges of the elongated planar member, the plurality of second engaging members protruding from each of the laterally opposed side edges in alignment with alternating ones of the second apertures.

12. The set of construction panels as recited in claim 8, wherein each of the first and second apertures is substantially circular, and each of the at least one first engaging member and the at least one second engaging member has a substantially oval cross-sectional contour.

13. The set of construction panels as recited in claim 8, wherein each of the first and second apertures is substantially circular, and each of the at least one first engaging member and the at least one second engaging member comprises a substantially cylindrical shell having an axial cut formed therethrough to define a pair of semi-cylindrical shell members, a free end of each of the semi-cylindrical shell members having a raised lip formed thereon.

14. A set of construction panels, comprising:

at least one first construction panel comprising a first elongated planar member having at least one side edge and at least one first engaging member protruding from the at least one side edge thereof, wherein a linear row of first apertures are formed through the first elongated planar member, further wherein the first elongated planar member has a pair of longitudinally opposed side edges and a pair of laterally opposed side edges, the at least one first engaging member comprising a plurality of first engaging members protruding from each of the laterally opposed side edges of the first elongated planar member, the plurality of first engaging members protruding from each of the laterally opposed side edges in alignment with alternating ones of the first apertures; and at least one second construction panel comprising a second elongated planar member having at least one side edge and at least one second engaging member protruding from the at least one side edge thereof, wherein a linear row of second apertures are formed through the elongated planar member, further wherein the second elongated planar member has a pair of longitudinally opposed side edges and a pair of laterally opposed side edges, the at least one second engaging member comprising a plurality of second engaging members protruding from each of the laterally opposed side edges of the second elongated planar member, the plurality of second engaging members protruding from each of the laterally opposed side edges in alignment with alternating ones of the second apertures, whereby the at least one first construction panel may be releasably connected to the at least one second construction panel by releasable insertion of at least one of the at least one first engaging member or the at least one second engaging member in a corresponding at least one of the second apertures or the first apertures, respectively.

* * * * *